US010162303B2

(12) United States Patent
Kataoka et al.

(10) Patent No.: US 10,162,303 B2
(45) Date of Patent: Dec. 25, 2018

(54) FIXING APPARATUS

(71) Applicant: CANON KABUSHIKI KAISHA, Tokyo (JP)

(72) Inventors: Hiroshi Kataoka, Suntou-gun (JP); Eiji Uekawa, Susono (JP); Keisuke Mochizuki, Suntou-gun (JP); Naoto Tsuchihashi, Yokohama (JP); Takayuki Mizuta, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/008,606

(22) Filed: Jan. 28, 2016

(65) Prior Publication Data

US 2016/0223962 A1 Aug. 4, 2016

(30) Foreign Application Priority Data

Jan. 29, 2015 (JP) ..... 2015-015747

(51) Int. Cl.
*G03G 21/16* (2006.01)

(52) U.S. Cl.
CPC ..... *G03G 21/1685* (2013.01); *G03G 21/1633* (2013.01); *G03G 2215/0132* (2013.01)

(58) Field of Classification Search
CPC ..... G03G 15/2017
See application file for complete search history.

(56) References Cited

U.S. PATENT DOCUMENTS 5,732,309 A * 3/1998 Okuno ..... G03G 15/2003 399/320
7,792,453 B2 * 9/2010 Baek ..... G03G 21/20 399/69
2009/0052924 A1 2/2009 Baek
2009/0162080 A1 * 6/2009 Matsuno ..... G03G 15/6573 399/16

(Continued)

FOREIGN PATENT DOCUMENTS

CN 101324778 A 12/2008
CN 103576517 A 2/2014

(Continued)

OTHER PUBLICATIONS

JP_2005077792_A_T MachineTranslation, JP, Japan, Mar. 2005, Gochi.*
JP_2007206275_A_T MachineTranslation JP, Aug. 2007, Maeda et al.*

*Primary Examiner* — Victor Verbitsky
(74) *Attorney, Agent, or Firm* — Canon U.S.A. Inc., IP Division

(57) ABSTRACT

A fixing apparatus fixes a toner image on a recording material by conveying and heating the recording material at a nip portion, and includes a first rotating member, a second rotating member configured to form the nip portion with the first rotating member, the first and second rotating members being arranged such that rotation of the second rotating member causes rotation of the first rotating member, a frame configured to support the second rotating member, so as to be rotatable and an opening and closing part arranged to (Continued)

open and close relative to the frame on the downstream side of the nip portion in the conveyance direction of the recoding material, the opening and closing part having a duct through which air flows.

11 Claims, 6 Drawing Sheets

(56) References Cited

U.S. PATENT DOCUMENTS

| | | | | |
|---|---|---|---|---|
| 2011/0236070 | A1* | 9/2011 | Mizuno | G03G 15/2064 399/122 |
| 2012/0315061 | A1 | 12/2012 | Kondo | |
| 2012/0328323 | A1 | 12/2012 | Murooka | |
| 2013/0051835 | A1* | 2/2013 | Kubo | G03G 15/2028 399/92 |

FOREIGN PATENT DOCUMENTS

| | | | | |
|---|---|---|---|---|
| JP | S62-084051 | U | | 5/1987 |
| JP | H09-050225 | A | | 2/1997 |
| JP | 2002-229364 | A | | 8/2002 |
| JP | 2005-077792 | A | | 3/2005 |
| JP | 2005352193 | A | | 12/2005 |
| JP | 2007206275 | A | * | 8/2007 |
| JP | 2008-116858 | A | | 5/2008 |
| JP | 2009098189 | A | | 5/2009 |
| JP | 2011-232427 | A | | 11/2011 |
| JP | 2014102486 | A | | 6/2014 |

* cited by examiner

FIXING APPARATUS

BACKGROUND OF THE INVENTION

Field of the Invention

The present invention relates to a fixing apparatus provided in an image forming apparatus using electrophotography.

Description of the Related Art

An image forming apparatus, such as a laser beam printer or an LED printer, includes a fixing apparatus that heat-fixes an unfixed toner image formed on a recording material onto the recording material. A fixing apparatus using a low-heat-capacity cylindrical film is known. Such a fixing apparatus generally includes a film, a heater in contact with an inner surface of the film, and a pressurizing roller that forms a nip portion with the heater with the film being disposed there between. The warm-up time of the fixing apparatus is short, and this can contribute to shortening of First Print Output Time (FPOT) of the image forming apparatus.

In this fixing apparatus, the film generally rotates due to rotation of the pressurizing roller. However, when a recording material absorbing moisture is conveyed and heated in the nip portion, vapor is sometimes produced near the nip portion. In particular, vapor is likely to be emitted to a surface of the pressurizing roller opposed to a surface of the recording material where a toner image is not formed. Condensation is caused, by the vapor, on the surface of the pressurizing roller. As a result, a phenomenon called "condensation slippage" occurs in which the frictional force of the pressurizing roller with the recording material and the film decreases and conveyance of the recording material becomes unstable.

Accordingly, Japanese Patent Laid-Open No. 2007-206275 discloses a structure in which a duct is provided such that an image forming apparatus and the inside of a fixing apparatus are connected there through and vapor near a pressurizing roller is scattered by blowing outside air against the pressurizing roller through the duct to realize stable conveyance of a recording material.

However, in the structure disclosed in Japanese Patent Laid-Open No. 2007-206275 in which air taken in from the outside of the fixing apparatus is directly sent to the pressurizing roller, the temperature of the pressurizing roller sometimes excessively decreases. Although it is conceivable to discharge air from the inside of the fixing apparatus to the outside, this is difficult under layout restrictions because it is necessary to discharge air from a portion near the nip portion where vapor is produced.

SUMMARY OF THE INVENTION

A fixing apparatus according to an aspect of the present invention fixes a toner image on a recording material by conveying and heating the recording material at a nip portion, and includes a first rotating member, a second rotating member configured to form the nip portion with the first rotating member, the first and second rotating members being arranged such that rotation of the second rotating member causes rotation of the first rotating member, a frame configured to support the second rotating member, so as to be rotatable and an opening and closing part arranged to open and close relative to the frame on the downstream side of the nip portion in the conveyance direction of the recoding material, the opening and closing part having a duct through which air flows.

Further features of the present invention will become apparent from the following description of exemplary embodiment with reference to the attached drawings.

DESCRIPTION OF THE EMBODIMENT

An embodiment of the present invention will be described below with reference to the drawings. Structures of a fixing apparatus and an image forming apparatus according to the embodiment of the present invention will be described with reference to FIGS. 1 to 7. Here, the overall structure of the image forming apparatus of the embodiment will be first described, and the structure and effects of the fixing apparatus of the embodiment will then be described in detail.

Embodiment

Overall Configuration of Image Forming Apparatus

1. Image Forming Apparatus

Figure 1:
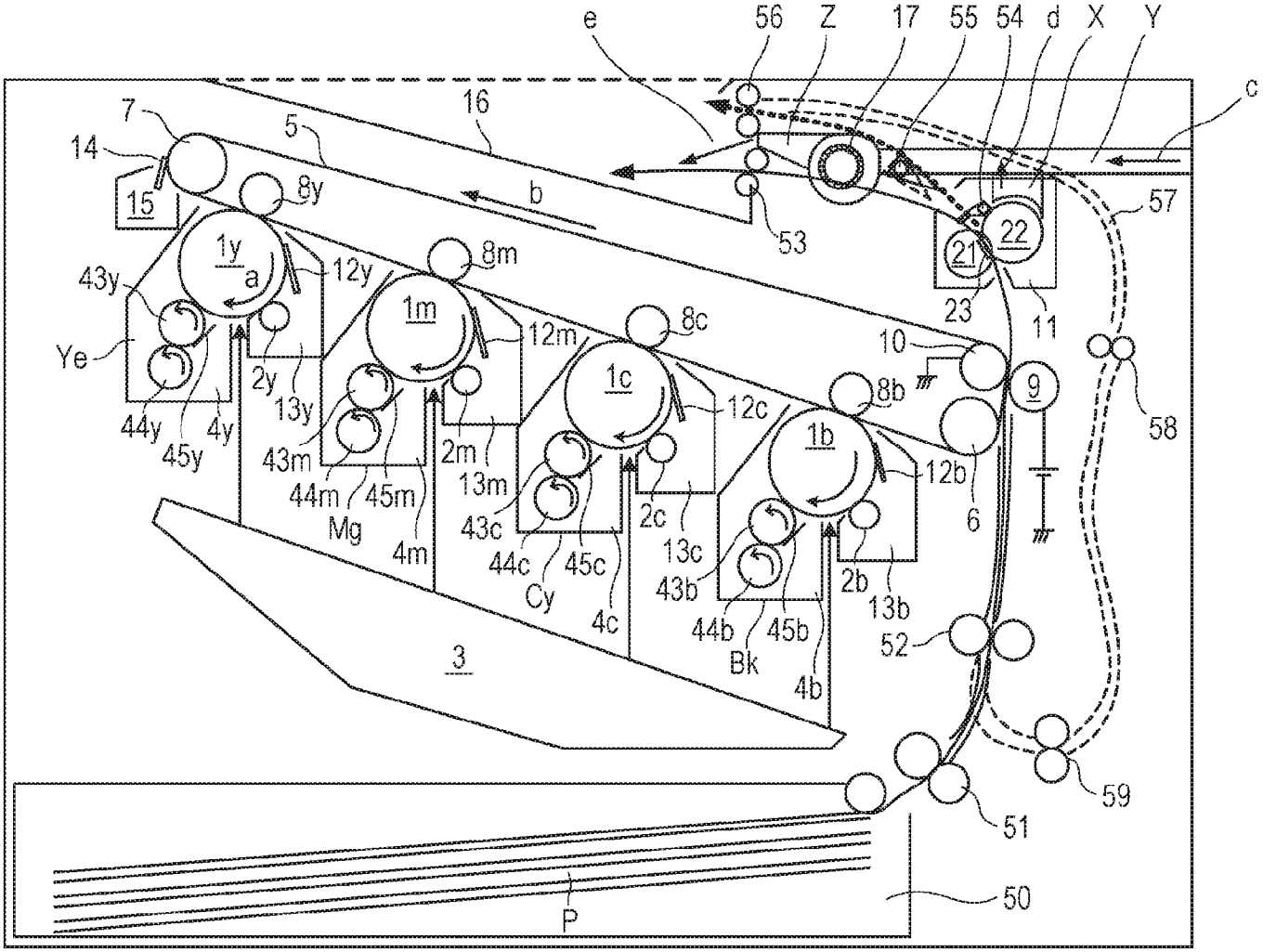
FIG. 1 is a cross-sectional view of an image forming apparatus.

FIG. 1 is a schematic cross-sectional view illustrating the configuration of an image forming apparatus according to the embodiment that is applied to an electro-photographic color laser printer having the function of forming images on both surfaces of a recording material P.

Image Forming Process

The embodiment adopts a laser beam printer using an electro-photographic process in which the process speed is 200 mm/sec and 35 ppm. Details of the image forming apparatus of the embodiment will be described below according to an image forming process.

As illustrated in FIG. 1, image forming units Ye, Mg, Cy, and Bk for yellow, magenta, cyan, and black toners, respectively, are arranged along a flat part of an intermediate transfer belt 5 serving as an intermediate transfer member. Since the image forming units Ye, Mg, Cy, and Bk have the same basic structure, only the yellow image forming unit Ye will be described in detail below.

In the yellow image forming unit Ye of FIG. 1, an image bearing member 1*y* is a cylindrical photosensitive member, and is rotationally driven at a peripheral speed of 200 mm/sec in a direction of arrow a, that is, in the clockwise direction in FIG. 1. A charging roller 2*y* is in pressure contact with a surface of the photosensitive member 1*y*, and the charging roller 2*y* rotates while following rotation of the photosensitive member 1*y*. An AC or DC high voltage is applied from a high-voltage power supply to the charging roller 2*y*, and the charging roller 2*y* charges the surface of the photosensitive member 1*y* with a desired potential.

The photosensitive member 1*y* is exposed according to image information by an exposure device 3 to form an electrostatic latent image. In the embodiment, a laser beam scanner is used as the exposure device 3.

A developing device 4*y* includes a developing roller 43*y*, a toner supplying roller 44*y* that supplies toner to the developing roller 43*y*, and a regulation blade 45*y* that regulates the toner layer thickness on the developing roller 43*y*. Toner is mainly composed of styrene acrylic resin, and a charge control component, silica, and so on are internally or externally added thereto as necessary.

The developing roller 43*y* is coated with toner and visualizes a latent image on the photosensitive member 1*y* into a toner image T. The toner supplying roller 44*y* that rotates in a direction opposite from the direction of the developing roller 43*y* is in contact with the developing roller 43*y*, and supplies and collects toner to and from the developing roller 43*y*.

The toner image T visualized on the photosensitive member 1*y* by the developing device 4*y* is conveyed to a primary transfer portion formed between the intermediate transfer belt 5 and the photosensitive member 1*y* along with the rotation of the photosensitive member 1*y*. The intermediate transfer belt 5 is driven in a direction of arrow b while being in contact with the photosensitive member 1*y*.

A primary transfer roller 8*y* is in pressure contact with the photosensitive member 1*y* with the intermediate transfer belt 5 being disposed there between. By applying a predetermined DC voltage from an unillustrated high-voltage power supply to the primary transfer roller 8*y*, a transfer electric field is generated in the primary transfer portion. After reaching the primary transfer portion, the toner image T is transferred onto a surface of the intermediate transfer belt 5 by the action of the transfer electric field.

The intermediate transfer belt 5 is stretched by a driving roller 6, a support roller 7, and an opposing roller 10 for secondary-transfer to form an intermediate transfer unit. Similarly to the image forming unit Ye, toner images T formed by the other image forming units Mg, Cy, and Bk are superimposed in order on the intermediate transfer belt 5 to form a full-color toner image T.

A recording material P is fed from a paper feeding unit 50 by a paper feeding roller pair 51 in accordance with the time when the full-color toner image T on the intermediate transfer belt 5 reaches a secondary transfer portion formed between a secondary transfer roller 9 and the intermediate transfer belt 5. The recording material P is conveyed to the secondary transfer portion by a registration roller pair 52 in synchronization with the full-color tone image T on the intermediate transfer belt 5.

At a time when the recording material P reaches the secondary transfer portion, a predetermined voltage is applied from the high-voltage power supply to the secondary transfer roller 9, so that the full-color toner image T is transferred onto the recording material P.

By the action of the secondary transfer voltage, a transfer current flows from the secondary transfer roller 9 via the recording material P, the intermediate transfer belt 5, and a secondary transfer opposing roller 10, and an electric field necessary for transfer is thereby formed.

The recording material P on which the full-color toner image T is transferred is separated from the secondary transfer portion, is conveyed to a fixing apparatus 11 serving as a fixing unit while bearing the toner image T, and is heated and pressurized. The toner image T on the recording material P is thereby fixed as a permanent image. Thus, toner images T of a plurality of colors are melted and mixed, and are fixed as a full-color image on the surface of the recording material P.

On the other hand, after the primary transfer, transfer residual toner on the photosensitive member 1*y* is cleaned by a photosensitive-member cleaner 12*y*, and is collected into a cleaner case 13*y*. After the secondary transfer, residual toner on the intermediate transfer belt 5 is collected into a waste-toner collecting container 15 by a cleaning device 14.

After being subjected to the fixing process using the fixing apparatus 11, the recording material P is output onto an output tray 16 through an output roller pair 53, and the print process is completed.

In the case of duplex printing for forming images on both surfaces of a recording material P, conveyance of the recording material P coming out of a nip portion N is controlled as follows. After printing on a front surface of the recording material P is finished, the recording material P passes over an upper surface of a movable guide member 55 (shown by a broken line in FIG. 1) that has moved to guide the recording material P to a duplex conveying path 57, and is then conveyed to a duplex output inverting roller pair 56 (shown by a broken arrow in FIG. 1). The duplex output inverting roller pair 56 is reversed at a time when a trailing end of the recording material P can be conveyed to the duplex conveying path 57, and the recording material P is thereby conveyed to the duplex conveying path 57. The recording material P is nipped and conveyed by a duplex conveying roller pair 58, passes through a duplex refeeding roller pair 59, and is re-fed to the registration roller pair 52 with its front and back surfaces thereof being inverted. Then, an image is formed on the back surface of the recording material P. After images are formed on both surfaces of the recording material P, the recording material P is output onto the output tray 16 through the output roller pair 53, and the print process is completed.

Fixing Apparatus

The fixing apparatus 11 adopts a film heating method using a thin film 21 having low heat capacity that can save energy and shorten the warm-up time. The fixing apparatus 11 will be described with reference to FIGS. 2 and 3.

The fixing apparatus 11 includes a cylindrical film 21 serving as a heating member (first rotating member), a heater 23 in contact with an inner surface of the film 21, and a pressurizing roller 22 (second rotating member) that forms a nip portion N with the heater 23 with the film 21 being disposed there between.

At least one of the film 21 and the pressurizing roller 22 is covered with a cover part 300. A heater holder 24 supports a surface of the heater 23 opposite from a surface in contact with the inner surface of the film 21. The heater holder 24 is formed of a high-heat-resistance resin such as LCP (liquid crystal polymer), PPS (polyphenylenesulfide), or PEEK (polyetheretherketone), or a composite material composed of the resin and glass fiber, metal or a ceramic material.

Figure 3:
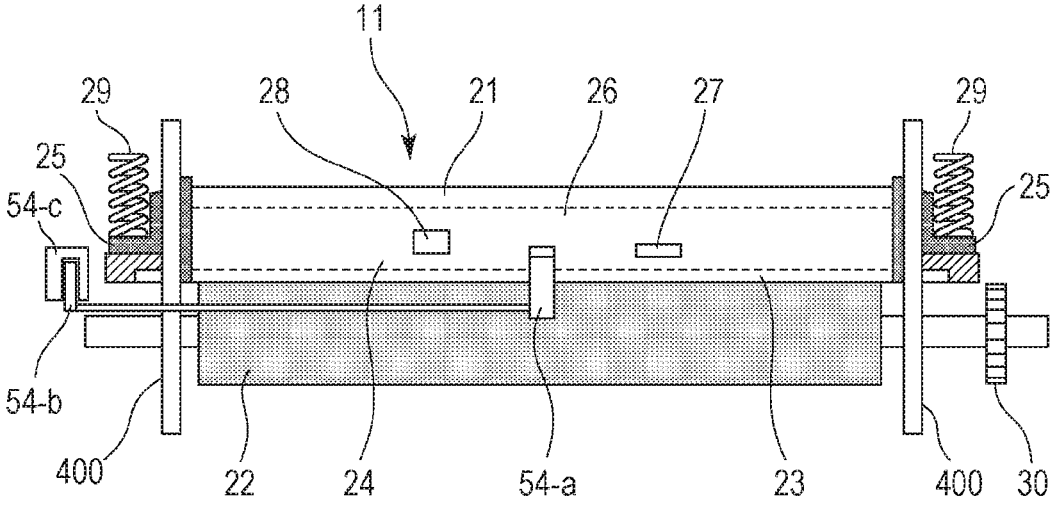
FIG. 3 is a longitudinal sectional view of the fixing apparatus.

As illustrated in FIG. 3, flanges 25 are provided as members for holding the film 21 rotatably around the heater holder 24. Similarly to the heater holder 24, the flanges 25 are formed of a high-heat-resistance resin or a composite material.

A metal stay 26 is a member that prevents longitudinal bending of the heater holder 24 to reliably form the nip portion N. The metal stay 26 is formed of iron, SUS (stainless steel) or the like and has a semi-ellipsoidal cross section.

The film 21 has a low heat capacity to shorten the warm-up time of the fixing apparatus 11. The film thickness of the film 21 is set at 100 μm or less, preferably 70 μm or less. A base layer of the film 21 is formed of resin such as PI (polyimide), PAI (polyamideimide), PEEK (polyetheretherketone), PES (polyethersulfone), or PPS (polyphenylene sulfide). Alternatively, the base layer of the film 21 may be formed of metal such as SUS. The film 21 is a composite layer film in which a front layer is formed of fluororesin having high releasability and a releasing layer is formed of PFA, PTFE, or FEP (a fluorinated ethylene-propylene copolymer). The film 21 is sometimes formed by forming an elastic layer of heat-resistant rubber, such as silicone rubber or fluororubber, between the base layer and the releasing layer. In the embodiment, a PI base layer having an inner diameter of 18 mm and a film thickness of 60 μm is coated with conductive PFA as a releasing layer.

The heater 23 includes a substrate 23-a, heat generating resistors 23-b provided on the substrate 23-a, and an overcoat layer 23-c provided on the heat generating resistors 23-b. The substrate 23-a is formed of a ceramic material such as alumina or aluminum nitride. Between the film 21 and the heater 23, an appropriate amount of Molykote special lubricant grease HP-300 manufactured by Dow Corning Toray Co., Ltd. is applied as grease formed of fluororesin to ensure slidability.

A thermistor 27 serving as a temperature detector for detecting the temperature is in contact with the heater 23. The thermistor 27 is provided in a sheet passing area on a surface of the heater 23 opposite from the surface in contact with the film 21. Power application to the heat generating resistors 23-b is controlled according to a signal from a control circuit unit (not illustrated).

Further, a safety element 28 is provided to ensure safety by stopping power application to the heat generating resistors 23-b when the heater 23 gets out of control and the temperature thereof abnormally rises. The safety element 28 has a structure in which a thermo-protector, such as a temperature fuse or a thermal switch, is inserted in series in a power application circuit of the heater 23. This structure ensures reliable safety.

The pressurizing roller 22 includes a metal core 22-a, an elastic layer 22-b, and a releasing layer 22-c. As illustrated in FIG. 3, both end portions of the metal core 22-a are rotatably supported by a frame 400 with bearings (not illustrated) being disposed there between. The pressurizing roller 22 is rotated in the clockwise direction by driving transmitted from a driving source (not illustrated) to a drive gear 30 fitted on one of the end portions of the metal core 22-a, and the film 21 is rotated to follow in the counterclockwise direction by the frictional force against the film 21. That is, the film 21 is rotated by the rotation of the pressurizing roller 22. The pressurizing roller 22 used in the embodiment includes a metal core 22-a formed of a free-machining steel material and having an outer diameter of 13 mm, an elastic layer 22-b formed of silicone rubber and having a thickness of about 3.5 mm, and a releasing layer 22-c formed by a PFA tube having a thickness of about 50 μm. In the embodiment, the outer diameter of the pressurizing roller 22 is about 20 mm, and the product hardness is 55° (Asker-C 1 Kg load).

The pressurizing roller 22 forms the nip portion N by being pressed against the film 21 with a total pressure of 156.8 N by pressurizing springs 29 with the flanges 25, the metal stay 26, the heater holder 24, and the heater 23 being disposed there between.

A fixing entrance guide 20 has the function of guiding and conveying a recording material P to the nip portion N.

After fixing on the recording material P is performed at the nip portion N in the fixing apparatus 11, the recording material P separates from the nip portion N, and is output from the fixing apparatus 11 along a first guide 31 and a pressurizing and separating output guide (second guide) 32 provided on a side of the film 21 and a side the pressurizing roller 22, respectively.

The first guide 31 and the second guide 32 are provided near the film 21 and the pressurizing roller 22 whose temperatures become high. Therefore, the first guide 31 and the second guide 32 are formed of resin having high heat resistance, such as PET (polyethylene terephthalate), PBT (polybutylene terephthalate), LCP (liquid crystal polymer), or PPS, so that the shapes thereof are not deformed by heat. A surface of the first guide 31 and a surface of the second guide 32 respectively have a conveying rib 31' and a conveying rib 32' provided parallel to the conveying direction of the recording material P in order to reduce the contact area with the recording material P.

In the fixing apparatus 11 of the embodiment, the second guide 32 on the side of the pressurizing roller 22 is provided with a duct through which air containing vapor near the surface of the pressurizing roller 22 is sucked inside the fixing apparatus 11 and the air is discharged to the outside of the fixing apparatus 11. By thus forming the duct in the second guide 32 opposed to the pressurizing roller 22, vapor near the surface of the pressurizing roller 22 can be directly sucked, and this can maximize intake efficiency. Further, it is unnecessary to separately forming the second guide 32 and the duct. This removes layout restrictions, and contributes to size reduction of the fixing apparatus 11.

Since fixing is a process for heating the recording material P, a recording-material sensor 54 serving as a recording-material detector for detecting the presence or absence of the recording material P at the nip portion N needs to be provided in a conveying area of a recording material P having the smallest possible width that is passed in the image forming apparatus. When the recording material P is present at the nip portion N in spite of the time when the recording P should not be present, the recording-material sensor 54 interrupts power supply to the heater 23 for safety. The recording-material sensor 54 may be of a mechanical type for detecting the recording material P when the recording material P changes its position by contact with the recording-material sensor 54, or of an electrical type for detecting the recording material P in a noncontact manner using transmitted light or the like. The former type is popularly used.

The recording-material sensor (detector) 54 of the mechanical type includes a contact portion 54-a movable by contact with the recording material P, a detection portion 54-b that is connected to the contact portion 54-a and moves integrally with the contact portion 54-a, and a sensor portion 54-c that outputs different signals according to the position of the detection portion 54-b. The detection portion 54-b and the sensor portion 54-c are provided out of the nip portion N and on the outer side of the ducts in the longitudinal direction of the pressurizing roller 22. This aims to allow an upper surface portion of the fixing apparatus 11 illustrated in FIG. 1 to be easily used as a conveying path for the recording material P when images are formed on both surfaces of the recording material P. This can also ensure the margin for the withstanding temperature limit of a detection element in the sensor portion 54-c. Moreover, since there is no need to form a mounting hole for the sensor portion 54-c in the ducts, intake efficiency can be enhanced.

Figure 2:
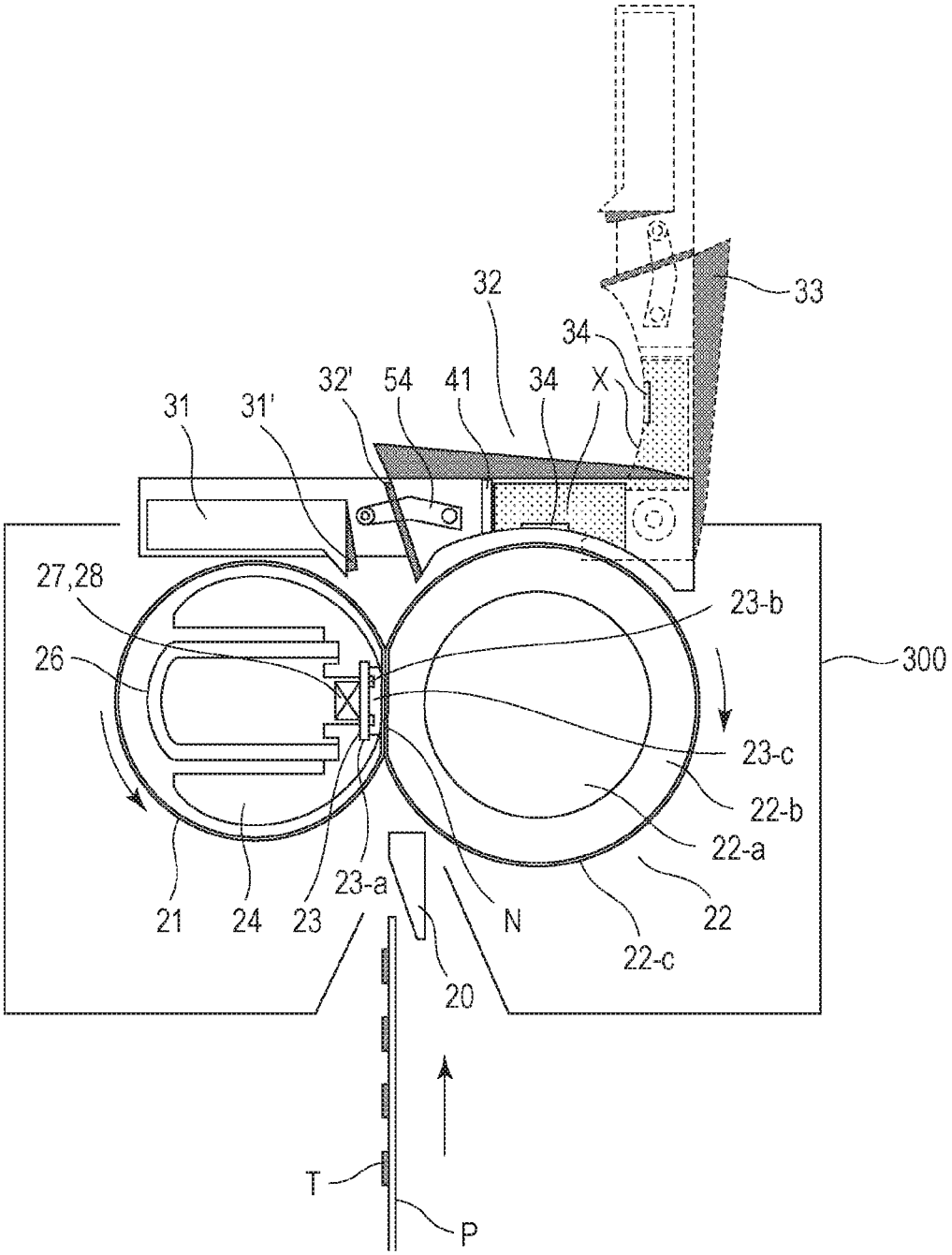
FIG. 2 is a cross-sectional view of a fixing apparatus.

However, both the detection portion 54-b and the sensor portion 54-c are sometimes provided at the longitudinal center of the fixing apparatus 11 according to the configuration of the image forming apparatus. Further, as illustrated in FIG. 2, a surface of the second guide 32 opposite from the pressurizing roller 22 serves as a duplex conveying path for the recording material P in duplex image formation, and the surface in contact with the recording material P is provided with a conveying rib 33 for duplex conveyance.

The above-described fixing apparatus 11 has a unit structure such as to be attached to and detached from a main body of the image forming apparatus. This structure allows the user to solve trouble, such as a conveyance malfunction of the recording material P and to replace the fixing apparatus 11 when the fixing apparatus 11 reaches the end of its lifetime.

2. Duct Structure

Figure 4:
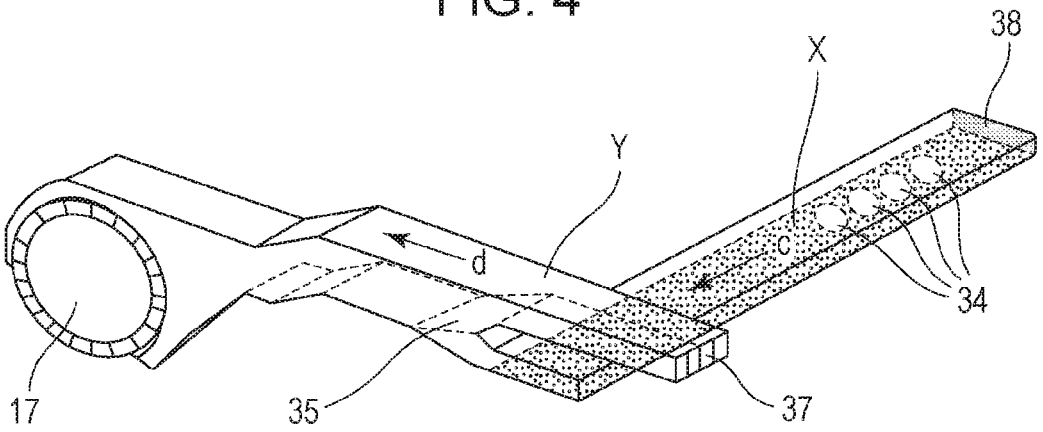
FIG. 4 illustrates ducts in the fixing apparatus.
Figure 5:
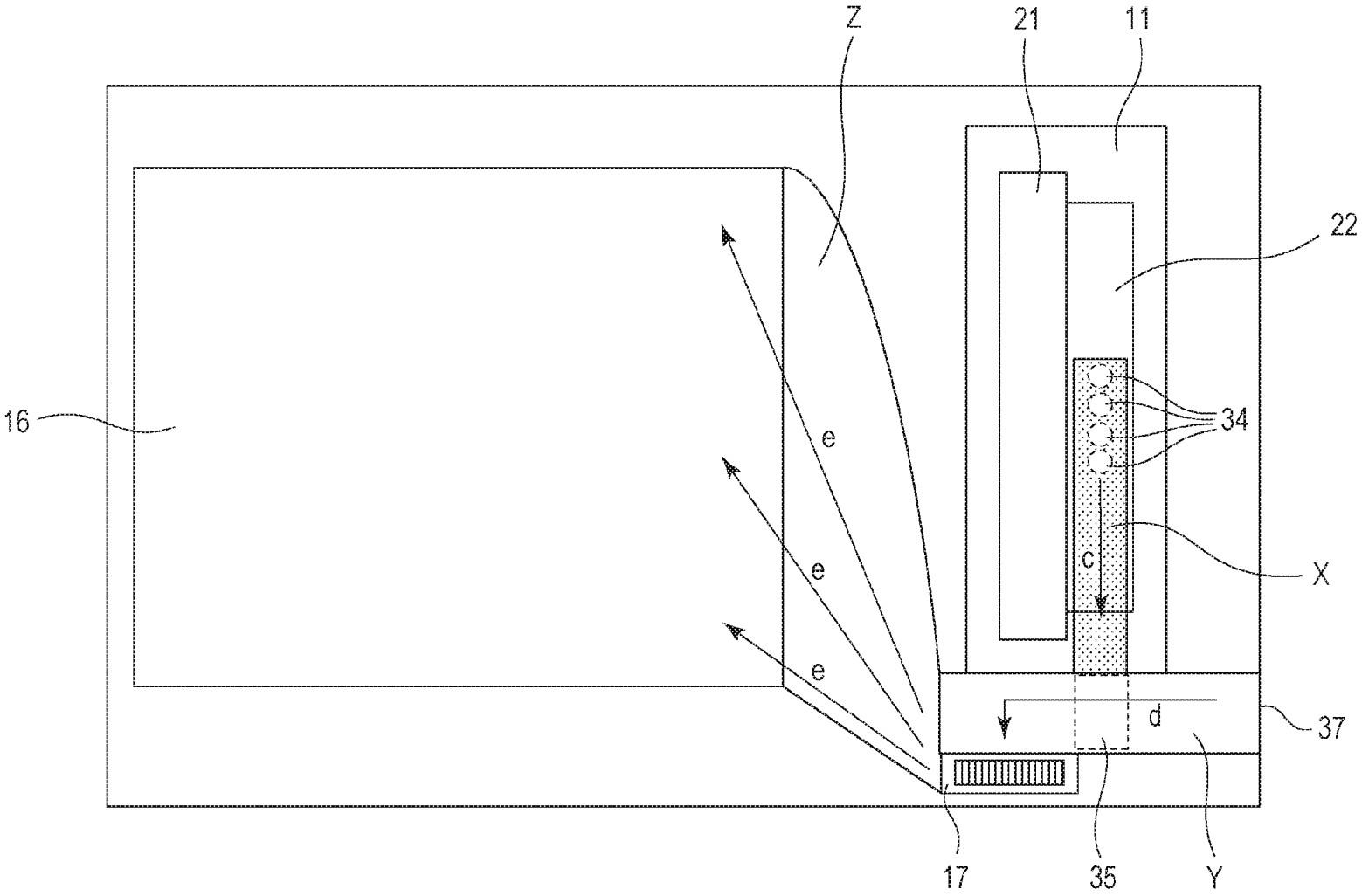
FIG. 5 illustrates ducts in the image forming apparatus.
Figure 6A:
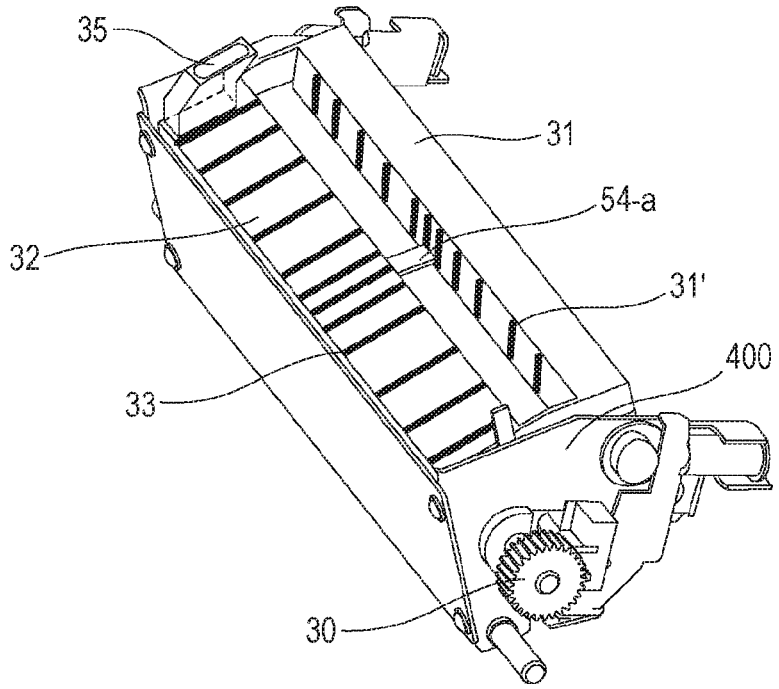
FIGS. 6A and 6B are perspective views of the fixing apparatus.
Figure 6B:
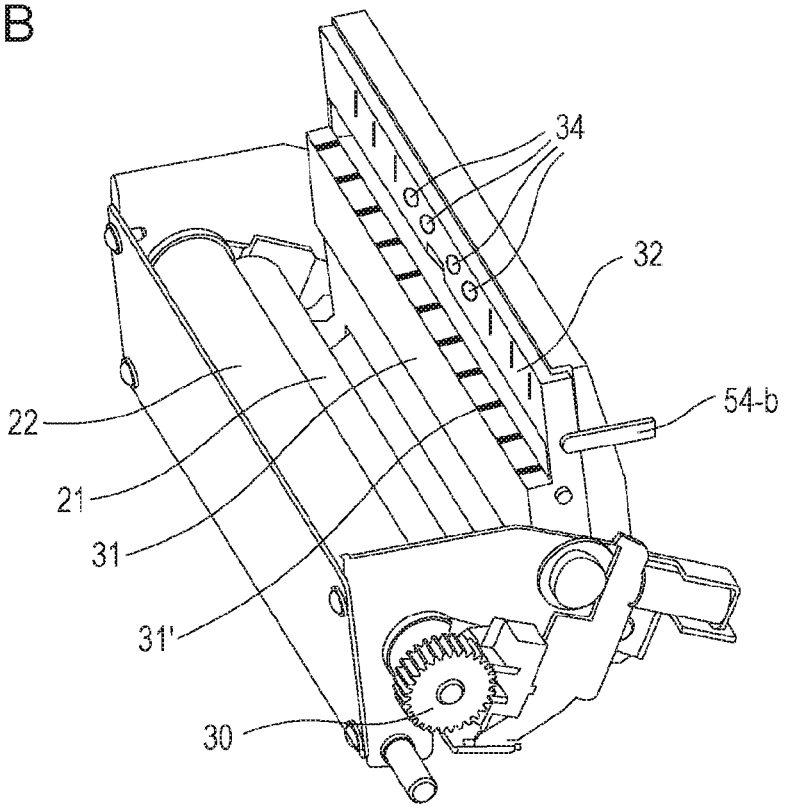
Figure 7:
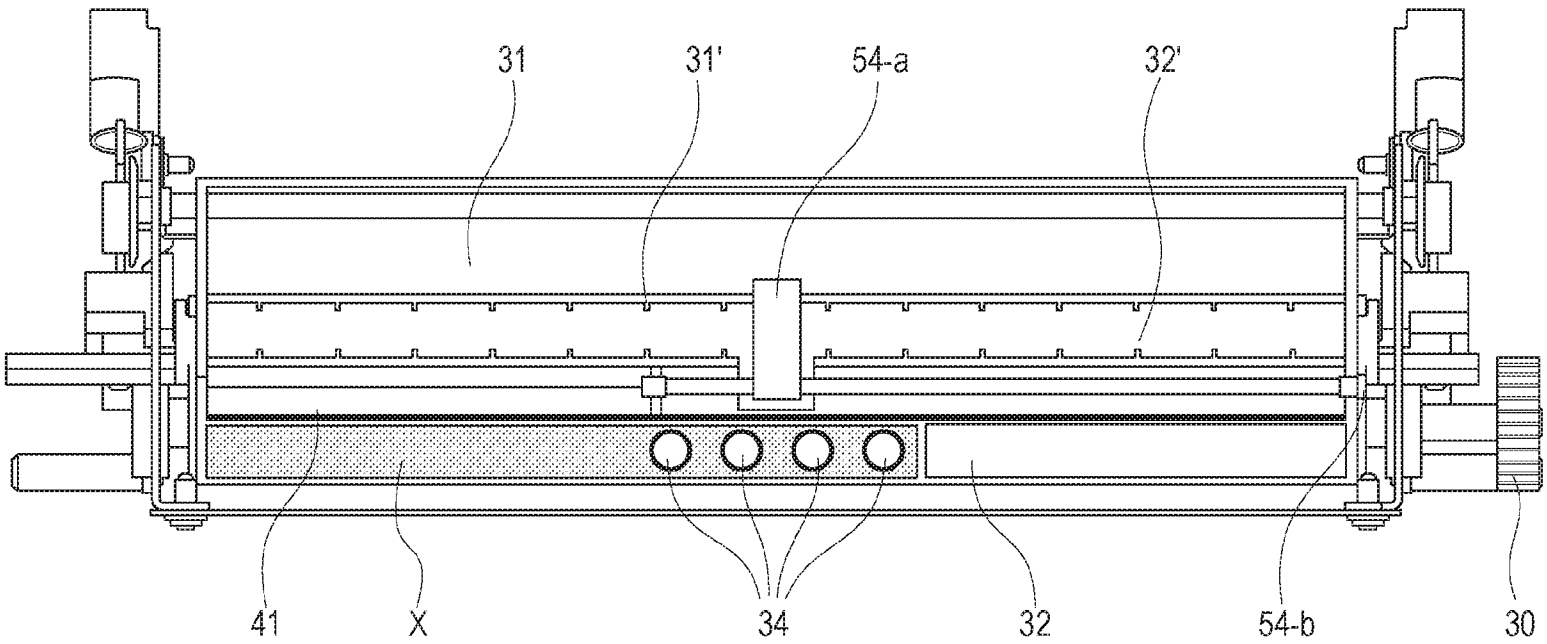
FIG. 7 illustrates ducts in the fixing apparatus.

Next, the structure of ducts in the fixing apparatus 11 and the image forming apparatus according to the embodiment will be described with reference to FIGS. 4 to 7. FIG. 4 illustrates ducts relating to the fixing apparatus 11, FIG. 5 illustrates ducts when the image forming apparatus is viewed from the upper side, FIGS. 6A and 6B are overall perspective views of the fixing apparatus 11, and FIG. 7 illustrates the ducts in the fixing apparatus 11. In these drawings, the flows of air are shown by arrows.

First, ducts and the flow of air in the embodiment will be described. As illustrated in FIG. 4, a duct X sucks air from intake ports (apertures) 34 provided in a surface of the second guide 32 opposed to the pressurizing roller 22 along a flow of arrow c from the inside of the fixing apparatus 11. The intake ports 34 is provided directly above at least one of the film 21 and the pressurizing roller 22 and directly faces at least one of the film 21 and the pressurizing roller 22. A duct Y sucks outside air from the outside of the image forming apparatus through intake ports 37 along a flow of arrow d. The duct X and the duct Y are connected in a connecting portion 35, where air from the fixing apparatus 11 and air from the outside of the image forming apparatus are mixed. The mixed air is sucked by a fan 17, and is then discharged to the outside of the image forming apparatus along flows of arrows e in a duct Z illustrated in FIG. 5.

Next, the functions of the ducts will be described. The duct X sucks high-temperature air containing vapor produced from a recording material P from a portion near the surface of the pressurizing roller 22 and discharges the sucked air to the outside of the fixing apparatus 11. The duct Y sucks low-temperature air in an atmosphere where the image forming apparatus is provided, and mixes the sucked air with the high-temperature air from the duct X to decrease the temperature of air flowing to the fan 17 through the ducts. The duct X and the duct Y are connected in the connecting portion 35. The duct Z blows air onto the recording material P output to the output tray 16 of the image forming apparatus to decrease the temperature of the recording material P.

Next, the purpose of blowing air onto the recording material P and the purpose of forming the duct Y will be described. Immediately after the recording material P is output to the output tray 16, when the temperature of a toner image T on the recording material P is higher than the temperature at which toner can melt, a phenomenon called "output-paper sticking" in which output recording materials P stick to each other sometimes occurs. The purpose of blowing air onto the recording materials P is to prevent output-paper sticking. When toner-image T surfaces of recording materials P face toward the output tray 16 in simplex printing, a toner-image T surface of a recording material P previously stacked sticks to a back surface of a succeeding recording material P. In duplex printing, toner-image T surfaces of recording materials P stick to each other. In a case in which such output-paper sticking occurs, when the user picks up the recording material P from the output tray 16, the toner image T may peel off and this may cause an image defect. As the countermeasures against this output-paper sticking, air is blown onto the recording material P to rapidly decrease the temperature of the toner image T on the recording material P to the toner setting temperature. This phenomenon has recently been apt to occur because the size of the image forming apparatus is reduced, high speed is achieved, and a succeeding recording material P is output before the temperature of a toner image T on a preceding recording material P falls to the setting temperature of the toner image T. Further, the use of duplex printing recommended because of the glow of environmental awareness also causes this phenomenon.

The duct Y is provided to decrease the temperature of air to be blown onto the recording material P. When only air from the duct X is blown onto the recording material P from the duct Z through the fan 17, the temperature of air sucked from the fixing apparatus 11 exceeds the temperature in the atmosphere where the image forming apparatus is provided, and the effect of suppressing sticking of recording materials is reduced. Accordingly, the temperature of air to be blown onto the recording material P is decreased by providing the duct Y for taking in air from the outside of the image forming apparatus. This increases the effect of suppressing output-paper sticking. Further, thermal damage to the fan 17 can be reduced by decreasing the temperature of air passing through the fan 17.

The fan 17 used in the embodiment is a multi-blade fan (sirocco fan) such that the rotation speed is 3100 rpm at input of a DC voltage of 24 V, the maximum air volume is 0.3 $m^3$/min, and the operating temperature limit is −10° to 70°.

The second guide 32 having the duct X has an open end at one end of the connecting portion 35 where the duct X joins the duct Y, and the second guide 32 is connected to the duct Y in the connecting portion 35 when the fixing apparatus 11 is mounted in the image forming apparatus. To prevent air leakage, a sponge-like member is attached to the connecting portion 35 to increase adhesiveness between the duct X and the duct Y. Further, a closed end 38 is provided on a side of the second guide 32 opposite from the open end where the duct X joins the duct Y so that air is sucked only from the intake ports 34.

Next, a description will be given of the position of the intake ports 34 provided in the second guide 32 in the longitudinal direction orthogonal to the conveying direction of the recording material P. When the intake ports 34 are provided only on the connecting portion 35 side of the second guide 32 opposed to the pressurizing roller 22, the airflow for sucking air near the surface of the pressurizing roller 22 on the side of the closed end 38 of the duct X weakens. Conversely, when the intake ports 34 are provided on only the closed end 38 side of the second guide 32 opposed to the pressurizing roller 22, the airflow for sucking air near the surface of the pressurizing roller 22 on the side of the connecting portion 35 weakens. Therefore, in the embodiment, the intake ports 34 are provided at a position corresponding to the longitudinal center of the pressurizing roller 22 so that the airflow for sucking air containing vapor is produced from the entire longitudinal area of the pressurizing roller 22. While the intake ports 34 are disposed in the longitudinal center of the pressurizing roller 22 in the embodiment, the structure is not limited to that of the embodiment according to the adopted form of the fixing apparatus 11.

The distance between the intake ports 34 provided in the second guide 32 of the duct X and the surface of the pressurizing roller 22 is 2.5 mm in a nominal design value. Although intake performance can be increased by decreasing this distance, the distance is set such that the elastic rubber layer 22-b does not interfere with the second guide 32 even when the elastic rubber layer 22-b is expanded and its outer diameter is increased by the temperature rise of the pressurizing roller 22.

If recording materials from which paper dust is apt to be produced are continuously subjected to fixing using the fixing apparatus 11, since the second guide 32 is to be in contact with conveyed recording materials P, paper dust produced from the recording materials P is likely to be attached to the second guide 32. If the paper dust is also attached and collects at the intake ports 34 of the second guide 32, intake efficiency sometimes decreases. Accordingly, the following structure is identified as a structure that can easily remove paper dust attached to the intake ports 34 of the duct X provided in the second guide 32.

In the structure of the embodiment, paper dust collected at the intake ports 34 can be easily removed because the second guide 32 on the side of the pressurizing roller 22 combined with the duct X is openable and closable. In the embodiment, the second guide 32 is configured as an opening and closing part that can open and close relative to the frame 400 of the fixing apparatus 11 as a guide portion combined with the first guide 31. This opening and closing part is provided on the downstream side of the nip portion N in the conveying direction of the recording material (on an exit side of the nip portion for the recording material). FIGS. 2, 6A, and 6B illustrate the structure of the opening and closing part. Solid lines in FIG. 2 and FIG. 6A illustrate a state in which the second guide 32 is closed and image formation is ready. Broken lines in FIG. 2 and FIG. 6B illustrate a state in which the user has removed the fixing apparatus 11 from the image forming apparatus and the second guide 32 shown by the broken lines in FIG. 2 is open. In this state, the intake ports 34 can be cleaned easily.

While the first guide 31 and the second guide 32 are combined into the opening and closing part in the embodiment, they may be opened and closed independently.

While the second guide 32 serves as the opening and closing part in the embodiment, the opening and closing part may have no guide function. For example, the opening and closing part may be opened and closed for jam recovery.

As described above, the duct for sucking air inside the fixing apparatus is provided in the opening and closing part that can open and close relative to the frame on the downstream of the nip portion in the conveying direction of the recording material. In this case, cleaning can be easily performed even when intake efficiency of the duct is decreased by suction of paper dust and the like.

Effect Verification-1

Next, verification of effects of the embodiment will be described. To verify the effects, in an endurance test, the influence of attachment of paper dust to the intake ports 34 was checked in the embodiment and a comparative example in which the first and second guides (separating and conveying guides) 31 and 32 could not be opened and closed.

The endurance test was carried out under the following conditions. Canon Extra A4 Red Label 80 gsm Copier Paper (manufactured by Canon Inc.) was used as paper, image formation was continuously performed and was conducted on only one surface of each recording material P. In an environment of 26° C./65% Rh, which was assumed as a normal office environment, an endurance test for 150000 prints was carried out. The effects were verified by checking the attachment state of paper dust to the intake ports 34 and condensation slippage as the conveyance performance of the recording materials P in the nip portion N. Regarding to the attachment state of paper dust to the intake ports 34, to check the flow of air flowing inside the duct X from the fixing apparatus 11, the air velocity in the connecting portion 35 was measured in a state in which the fan 17 was operating. The air velocity was measured with an air velocity and air temperature sensor UAS-1000 (manufactured by Degree Controls, Inc.). The volume of air flowing in the connecting portion 35 was calculated by multiplying the cross-sectional area of the duct X in an air velocity measuring section by the air velocity. Table 1 shows calculated air velocities and air volumes.

The check contents of condensation slippage will be described. Condensation slippage is a phenomenon in which the level worsens as the amount of vapor produced from the recording material P increases. Accordingly, as a condition where the amount of vapor produced from the recording material P increased, a recording material P was left for 48 hours in an environment of 30° C./80% Rh as a high-temperature and high-humidity environment in order to increase the amount of vapor contained in the recording material P. As images, a Ye toner image and a MG toner image were formed as solid images over the entire surface of each recording material P so that vapor contained in the recording material P was produced only from the side of the pressurizing roller 22 and a film of vapor was easily formed between the pressurizing roller 22 and the recording material P. The recording material P was CS-680 (from Canon Marketing Japan Inc.), image formation was continuously performed on 10 recording materials and only on one surface of each recording material P, and verification was conducted in the above-described environment of 30° C./80% Rh. Table 2 shows the result of verification. In Table 2, ○ shows that trouble of conveyance did not occur, Δ shows that conveyance performance became unstable in the fixing nip and an image defect was caused although a conveyance malfunction did occur, and x shows that a conveyance malfunction occurred.

When the decrease in air velocity was confirmed and conveyance performance of the recording materials P was reduced in these verifications, the intake ports 34 of the duct X that were characteristic of the embodiment were cleaned only in the embodiment, and verification was performed again.

TABLE 1

| | Embodiment | | Comparative Example | |
|---|---|---|---|---|
| | Air Velocity (m/sec) | Air Volume ($m^3$/min) | Air Velocity (m/sec) | Air Volume ($m^3$/min) |
| Beginning | 1.5 | 0.0079 | 1.5 | 0.0079 |
| 5000 | 1.45 | 0.0077 | 1.45 | 0.0077 |
| 10000 | 1.4 | 0.0074 | 1.45 | 0.0077 |
| 25000 | 1.3 | 0.0069 | 1.35 | 0.0071 |
| 50000 | 0.95 | 0.005 | 0.9 | 0.0048 |
| | Cleaning of Intake Ports | | — | |
| 50001 | 1.5 | 0.0079 | 0.9 | 0.0048 |
| 75000 | 1.3 | 0.0069 | 0.75 | 0.0040 |
| 100000 | 1 | 0.0053 | 0.7 | 0.0037 |
| | Cleaning of Intake Ports | | — | |
| 100001 | 1.5 | 0.0079 | 0.7 | 0.0037 |
| 150000 | 0.9 | 0.0048 | 0.45 | 0.0024 |
| | Cleaning of Intake Ports | | — | |
| 150001 | 1.45 | 0.0077 | 0.45 | 0.0024 |

TABLE 2

| | Embodiment | Comparative Example |
|---|---|---|
| Beginning | ○ | ○ |
| 5000 | ○ | ○ |
| 10000 | ○ | ○ |
| 25000 | ○ | ○ |
| | Cleaning of Intake Ports | — |
| 50001 | ○ | Δ |
| 75000 | ○ | Δ |
| | Cleaning of Intake Ports | — |
| 100001 | ○ | Δ |
| | Cleaning of Intake Ports | — |
| 150001 | ○ | X |

As shown by the above results, in the embodiment, when the volume of air flowing through the duct X decreased, the intake ports 34 were cleaned to remove paper dust, and the volume of air was checked again. As a result, it was confirmed that the air volume returned to the one in an initial state in which paper dust was not attached. It was also confirmed that a condensation slippage phenomenon did not occur and the recording materials P were conveyed without any trouble in this state.

Effect Verification-2

Next, a description will be given of verification of a structure in which the space of the duct X provided inside the second guide 32 and a space including the recording-material sensor 54 for detecting the presence or absence of the recording material P in the nip portion N, with reference to FIGS. 2 and 7. FIG. 7 is a top view of the fixing apparatus 11 from which a part of the second guide 32 that forms the duplex conveying path is removed.

Verification was performed by comparing the air velocity at the intake ports 34 in a case in which a separating wall 41 was provided to separate the space of the duct X and the space including the recording-material sensor 54, as illustrated in FIGS. 2 and 7, and a case in which the separating wall 41 was not provided. The air velocity was measured with an air velocity and air temperature sensor UAS-1000, similarly to the above.

When the separating wall 41 for separating the spaces was provided as in the embodiment, the air velocity was 0.4 to 0.45 m/sec. In contrast, when the separating wall 41 was not provided, the air velocity was 0.14 to 0.21 m/sec, which was about half the air velocity of the embodiment.

This shows that, since a shaft of the recording-material sensor 54, a rib for receiving the shaft, and so on are provided in the space including the recording-material sensor 54 and these members hinder the flow of air, the loss increases and the air velocity at the intake ports 34 decreases. Hence, even when paper dust is not attached to the intake ports 34, the volume of air flowing in the duct X also decreases. When the air velocity in the duct X was measured and the air volume was calculated to confirm that, similarly to the above verification-1, it was confirmed that the air volume was a small value of 0.003 $m^3$/min or less and that the effect of suppressing condensation slippage was lost.

On the basis of the above verifications, the present invention adopts the structure in which the space of the duct X provided in the second guide 32 is separate from the space including the recording-material sensor 54.

In the fixing apparatus in which the heating member serves to convey a recording material P, the same effects as those of the embodiment can be obtained by forming a duct in the first guide 31 opposed to the heating member. Both the first guide 31 and the second guide 32 may be provided with their respective ducts.

According to the above-described embodiment, it is possible to provide a fixing apparatus in which condensation slippage can be suppressed for a long time without excessively cooling a pressurizing roller.

While the present invention has been described with reference to an exemplary embodiment, it is to be understood that the invention is not limited to the disclosed exemplary embodiment. The scope of the following claims is to be accorded the broadest interpretation so as to encompass all such modifications and equivalent structures and functions.

This application claims the benefit of Japanese Patent Application No. 2015-015747, filed Jan. 29, 2015, which is hereby incorporated by reference herein in its entirety.

What is claimed is:

1. A fixing apparatus for fixing a toner image on a recording material, the fixing apparatus comprising:

a pair of rotating members configured to form a nip portion at which the recording material, on which the toner image has been formed, is conveyed and heated, the pair of rotating members including a cylindrical film and a pressure roller;

a frame configured to support the pair of rotating members rotatably; and an opening and closing door configured to be movable between an open position and a closed position relative to the frame on a downstream side of the nip portion in a conveyance direction of the recoding material, the opening and closing door including a duct in which air flows toward an outside of the fixing apparatus, wherein the recording material is being conveyed at the nip portion while the opening and closing door is in the closed position, wherein the duct includes an aperture through which air near the pair of rotating members is sucked into the duct, the aperture being provided in a position in which the pressure roller faces the aperture and in which the recording material does not pass through the aperture, wherein the opening and closing door includes a rod having a first portion movable by contact with the recording material and a second portion movable integrally with the first portion, and includes a sensor configured to output different signals according to the position of the second portion of the rod, and wherein the second portion of the rod and the sensor are provided on an outer side of the area where the duct is provided in a longitudinal direction of the pair of rotating members.

2. The fixing apparatus according to claim 1, wherein the opening and closing door includes a guide rib configured to guide the recording material, the guide rib provided on a side of the opening and closing door opposite to a side of the opening and closing door on which the aperture is provided.

3. The fixing apparatus according to claim 1, further comprising:

a heater in contact with an inner surface of the film, the heater forming the nip portion with the roller, the film being disposed between the heater and the roller.

4. The fixing apparatus according to claim 1, wherein the aperture is provided above the pressure roller.

5. The fixing apparatus according to claim 4, wherein the aperture is provided at a position corresponding to a center portion of the pressure roller in a longitudinal direction of the pressure roller.

6. The fixing apparatus according to claim 1, wherein when the aperture is a first aperture, the fixing apparatus includes a second aperture through which the recording material, on which the toner image has been fixed at the nip portion, passes and is discharged to an outside of the apparatus, wherein a width of the first aperture in a width direction of the recording material perpendicular to the conveyance direction of the recoding material is smaller than a width of the second aperture in the width direction.

7. The fixing apparatus according to claim 6, wherein the opening and closing door includes the second aperture.

8. The fixing apparatus according to claim 1, wherein when the aperture is a first aperture, the fixing apparatus includes a second aperture through which the recording material, on which the toner image has been fixed at the nip portion, passes and is discharged to an outside of the fixing apparatus, and wherein the air sucked into the duct through the first aperture is discharged to an outside of the fixing apparatus not through the second aperture.

9. The fixing apparatus according to claim 1, wherein the air sucked into the duct through the aperture flows in a longitudinal direction of the pair of rotating members in the duct.

10. A fixing apparatus for fixing a toner image on a recording material, the fixing apparatus comprising:

a pair of rotating members configured to form a nip portion at which the recording material, on which the toner image has been formed, is conveyed and heated, one of the pair of rotating members having a heater and the other of the pair of rotating members does not have the heater;

a frame configured to support the pair of rotating members rotatably; and an opening and closing door configured to be movable between an open position and a closed position relative to the frame on a downstream side of the nip portion in a conveyance direction of the recoding material, the opening and closing door including a duct in which air flows toward an outside of the fixing apparatus, wherein the recording material is being conveyed at the nip portion while the opening and closing door is in the closed position, wherein the duct includes an aperture through which air near the pair of rotating members is sucked into the duct, the aperture being provided in a position in which the other of the pair of rotating members faces the aperture and in which the recording material does not pass through the aperture, wherein the opening and closing door includes a rod having a first portion movable by contact with the recording material and a second portion movable integrally with the first portion, and includes a sensor configured to output different signals according to the position of the second portion of the rod, and wherein the second portion of the rod and the sensor are provided on an outer side of the area where the duct is provided in a longitudinal direction of the pair of rotating members.

11. The fixing apparatus according to claim 10, wherein the one of the pair of rotating members includes a cylindrical film and the other of the pair of rotating members includes a pressure roller.

* * * * *